US007144283B2

(12) United States Patent
Kawase

(10) Patent No.: US 7,144,283 B2
(45) Date of Patent: Dec. 5, 2006

(54) BOAT LAN SYSTEM

(75) Inventor: Koji Kawase, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/257,213

(22) Filed: Oct. 24, 2005

(65) Prior Publication Data

US 2006/0089059 A1 Apr. 27, 2006

(30) Foreign Application Priority Data

Oct. 22, 2004 (JP) ..... 2004-308251

(51) Int. Cl.
*B60W 10/04* (2006.01)

(52) U.S. Cl. ..... 440/84; 701/21

(58) Field of Classification Search ..... 440/1, 440/2, 84; 701/21
See application file for complete search history.

(56) References Cited

U.S. PATENT DOCUMENTS 6,382,122 B1 5/2002 Gaynor et al.
6,872,106 B1 * 3/2005 Kanno ..... 440/2
6,910,927 B1 * 6/2005 Kanno ..... 440/1
2003/0093196 A1 * 5/2003 Okuyama ..... 701/21
2004/0059478 A1 * 3/2004 Okuyama ..... 701/21
2005/0118895 A1 * 6/2005 Kanno et al. ..... 440/2
2005/0170713 A1 * 8/2005 Okuyama ..... 440/59

* cited by examiner

*Primary Examiner*—Stephen Avila
(74) *Attorney, Agent, or Firm*—Knobbe, Martens, Olson & Bear, LLP

(57) ABSTRACT

A boat Local Area Network (LAN) system can be used to connect devices such as gauges, remote control units and the like disposed in a hull and a propulsion unit mounted on the hull of the boat. The LAN system can comprise a pilot seat-side front hub connected with the devices and a stern-side hub connected with the engine controller. The pilot seat-side front hub and the stern-side hub can be connected by a bus cable having a power supply line, and a system power supply terminal can be provided on at least one of the pilot seat-side front hub and the stern-side hub.

13 Claims, 5 Drawing Sheets

BOAT LAN SYSTEM

PRIORITY INFORMATION

This application is based on and claims priority under 35 U.S.C. §119 to Japanese Patent Application No. 2004-308251, filed on Oct. 22, 2004, the entire contents of which is hereby expressly incorporated by reference herein.

BACKGROUND OF THE INVENTION

1.Field of the Invention

The present inventions are directed to control systems for controlling various devices on a boat, such as boats with one or more outboard motors.

2. Description of the Related Art

Outboard motor-powered boats usually have many kinds of wires, cables and hoses for connecting the inboard equipment with the outboard motor. The number and types of connections of the wires, cables and hoses required for installing an outboard motor onto a boat makes the installation process slow, particularly if a plurality of outboard motors are mounted to the boat.

In recent years, local area networks (LAN) have become more popular for use in connecting components of a boat. In these types of systems, one or plurality of outboard motors are connected to devices, such as remote control devices, speedometers, tachometers, etc. Various kinds of signals are transmitted between the outboard motors and the inboard devices.

For example, U.S. Pat. No. 6,382,122 describes a system in which devices disposed, for example, in a pilot's seating area are connected through a LAN system forming a network between the devices and engine controllers of a plurality of outboard motors mounted on the stern.

SUMMARY OF THE INVENTION

An aspect of the least one embodiment disclosed in herein includes the realization that where the wires of a power supply circuit for network hardware are unnecessarily long, the voltage of the power supply to the network hardware components can become unstable and thereby interfere with normal operations. For example, conventional power supply circuits for LAN systems used on boats draw power from a power supply (battery) connected to an outboard motor through a power supply circuit of the engine. In such a case, the path through which electric power is supplied to the boat LAN system is longer, and thus electric noise generated within the engine or a voltage drops occur, thereby causing an instability in the operation of the boat LAN system.

In addition, if a plurality of outboard motors are mounted on the stern of a boat, there can be a separate battery connected to each outboard motor. Thus a power supply of the LAN system can be connected to both power circuits of the outboard motors for, which can result in a complicated circuit.

On the other hand, electric power of the boat LAN system can be supplied from only one of the batteries connected to the outboard motor, and thus the degree of freedom of power supply is lowered.

Thus, in accordance with at least one embodiment disclosed herein, a network system is provided for a boat having operator's devices disposed in a hull, a propulsion unit mounted on the hull, and an engine for driving the propulsion unit. The network system can comprise a pilot seat-side front hub connected with the operator's devices, a stern-side hub connected with a controller for the engine, a bus cable having a power supply line connecting the pilot seat-side front hub with the stern-side hub, and at least a first system power supply terminal provided on at least one of the pilot seat-side front hub and the stern-side hub. The network system can be configured such that both of the pilot seat-side front hub and the stern-side hub can be powered by a single power supply being connected to the first power supply terminal.

In accordance with at least another embodiment disclosed herein, a network system is provided for a boat having operator's devices disposed in a hull, a propulsion unit mounted on the hull, and an engine for driving the propulsion unit. The network system can comprise a pilot seat-side front hub connected with the operator's devices, a stern-side hub connected with a controller for the engine, and at least a first system power supply terminal provided on at least one of the pilot seat-side front hub and the stern-side hub. Additionally, the network system can include means for powering both of the pilot seat-side front hub and the stern-side hub can with a single power supply being connected to the first power supply terminal.

In accordance with at least a further embodiment disclosed herein, a boat can have operator's devices disposed in a hull, a propulsion unit mounted on the hull, and an engine for driving the propulsion unit. The boat can also include a network system comprising a pilot seat-side front hub connected with the operator's devices, a stern-side hub connected with a controller for the engine, a bus cable having a power supply line connecting the pilot seat-side front hub with the stern-side hub, and at least a first system power supply terminal provided on at least one of the pilot seat-side front hub and the stern-side hub. The network system can be configured such that both of the pilot seat-side front hub and the stern-side hub can be powered by a single power supply being connected to the first power supply terminal.

BRIEF DESCRIPTION OF THE DRAWINGS

FIG. 2(*b*) is a front elevational view of the pilot seat-side front hub of FIG. 2(*a*);

FIG. 4(*b*) is a front elevation view of the stern-side hub of FIG. 4(*a*);

DETAILED DESCRIPTION OF THE PREFERRED EMBODIMENT

Figure 1:
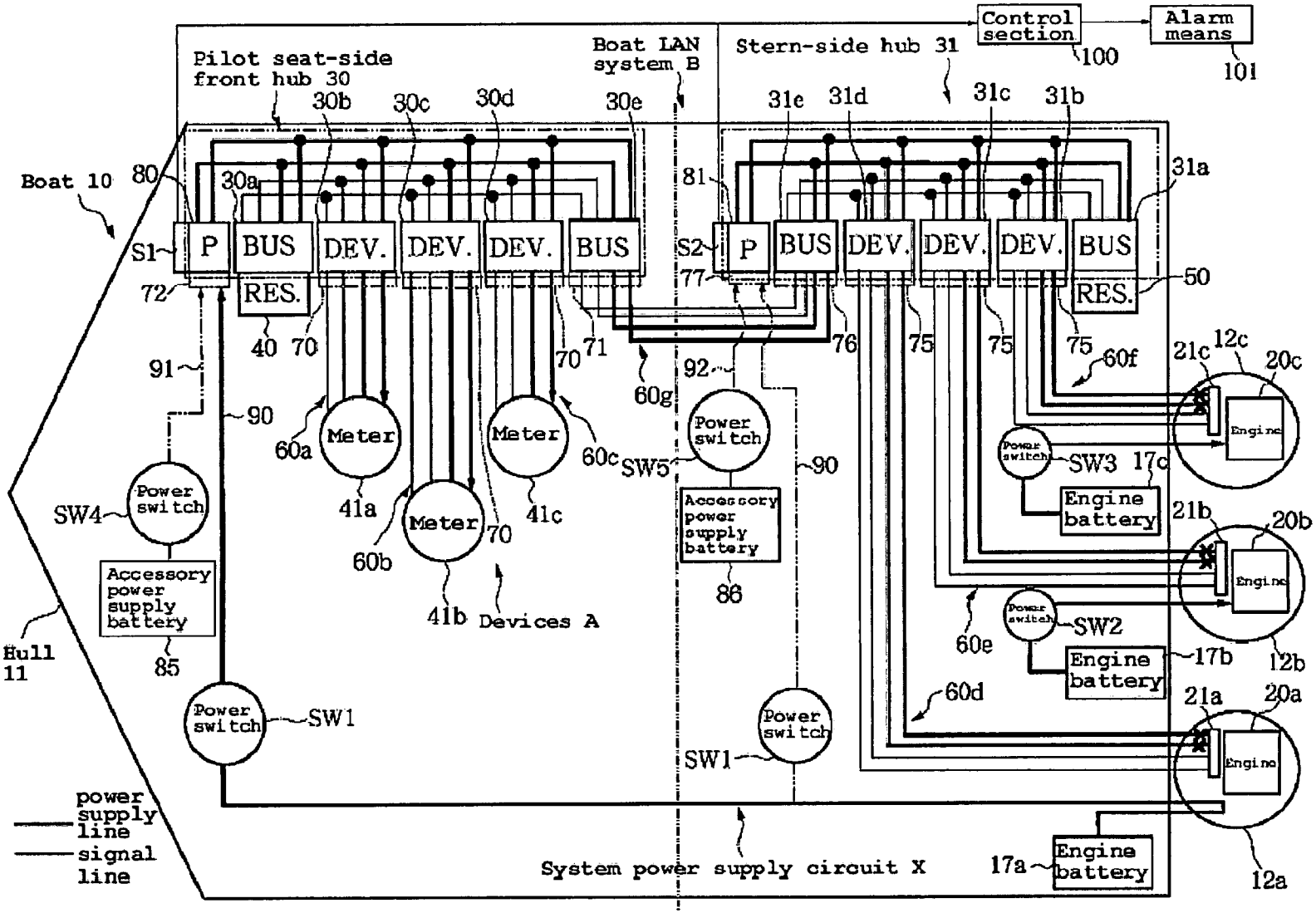
FIG. 1 is a schematic illustration of a boat LAN system provided on a boat, in accordance with an embodiment.

FIG. 1 is a schematic top plan view of a boat 10 including a LAN connecting a plurality of outboard motors. The embodiments disclosed herein are described in the context of a marine propulsion system of a boat because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and dust, the inventions disclosed herein are not limited to the disclosed exemplary embodiments.

The boat 10 of this embodiment has a hull 11 for passengers on board and three outboard motors 12*a*, 12*b*, 12*c* mounted as propulsion units for the hull 11, at the stern of the boat 10. The outboard motors 12*a*, 12*b*, 12*c* have engines 20*a*, 20*b*, 20*c* and engine controls 21*a*, 21*b*, 21*c*, respectively. Although in this embodiment three outboard motors 12*a*, 12*b*, 12*c* are mounted to the hull 11 at the stern, one, two, or more than three outboard motors can be mounted to the hull.

A pilot seat-side front hub 30 is disposed at the front of the hull 11 and a stern-side hub 31 is disposed at the rear of the hull 11. These hubs 30, 31 are used as current or signal collectors/distributors in the manner well-known in the art of networking. The pilot seat-side front hub 30 and the stern-side hub 31 can be formed in the shapes illustrated FIG. 2 and FIG. 4. Other shapes can also be used.

Figure 2:
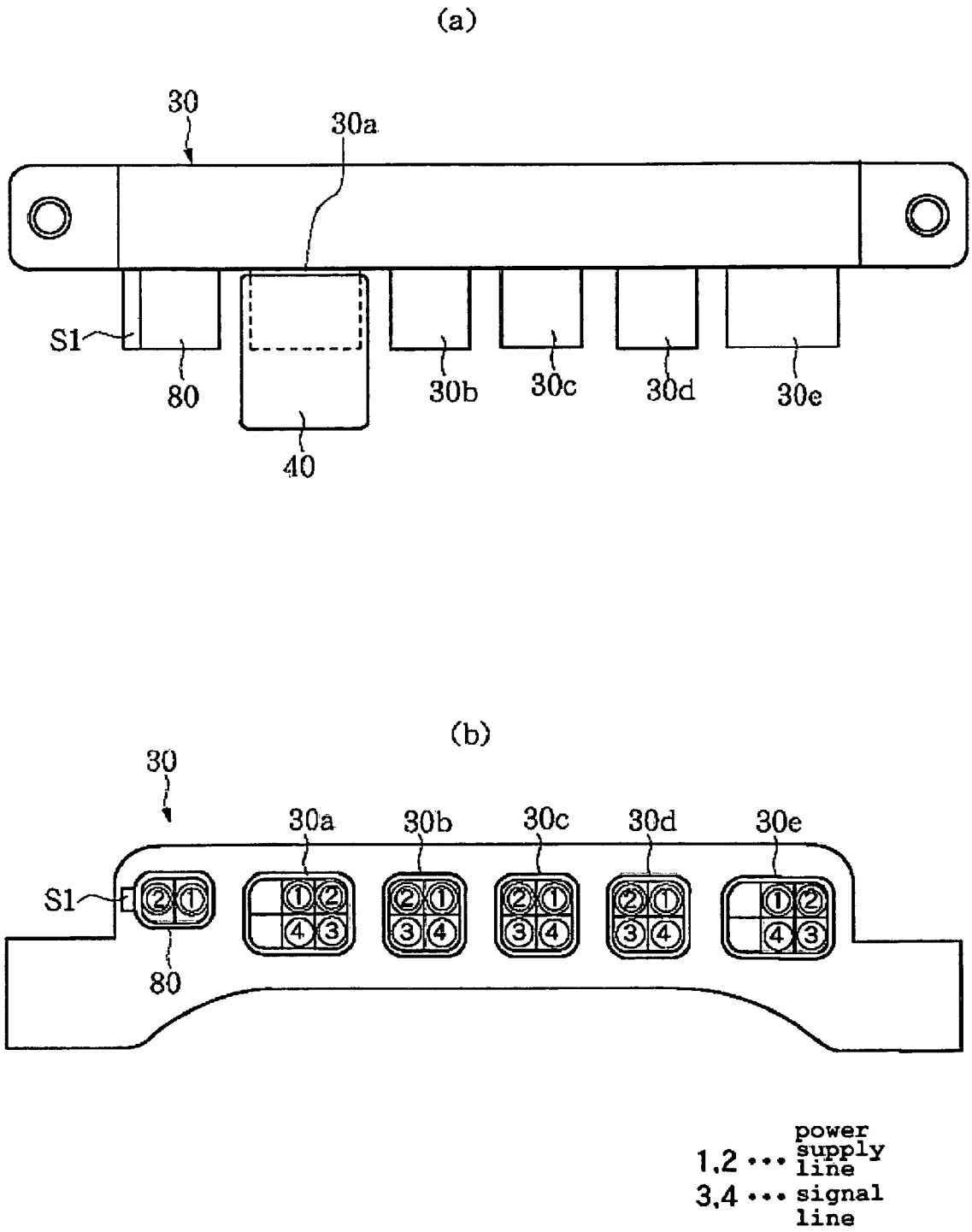
FIG. 2(*a*) is a top plan view of a pilot seat-side front hub.

The pilot seat-side front hub 30 is provided with, as shown in FIG. 1 and FIG. 2, a terminating resistance connecting terminal BUS30*a*, device connecting terminals DEV30*b*–30*d*, a HUB connecting terminal BUS30*e* and a system power supply terminal P80. The terminating resistance connecting terminal BUS30*a* is connected with a terminating resistance device RES40.

The device connecting terminals DEV30*b*–30*d* can be connected with meters 41*a*, 41*b*, 41*c* constituting devices A, by Controller Area Network (CAN)-supporting LAN cables 60*a*, 60*b*, 60*c*. The meters 41*a*, 41*b*, 41*c* can be in the form of speedometers, oil pressure and/or level gauges, tachometers, and/or remote control devices for adjusting throttle position or gear position, and the like. Such devices are also referred to herein as "operator's devices." These LAN cables 60*a*, 60*b*, 60*c* can be connected with fitting connectors 70 shown in FIG. 3(*b*). The LAN cables 60*a*, 60*b*, 60*c* each have signal lines and power supply lines. An exemplary layout of the signal line connectors and power supply connectors within the fitting connectors 70's illustrated in FIG. 3(*b*).

Figure 4:
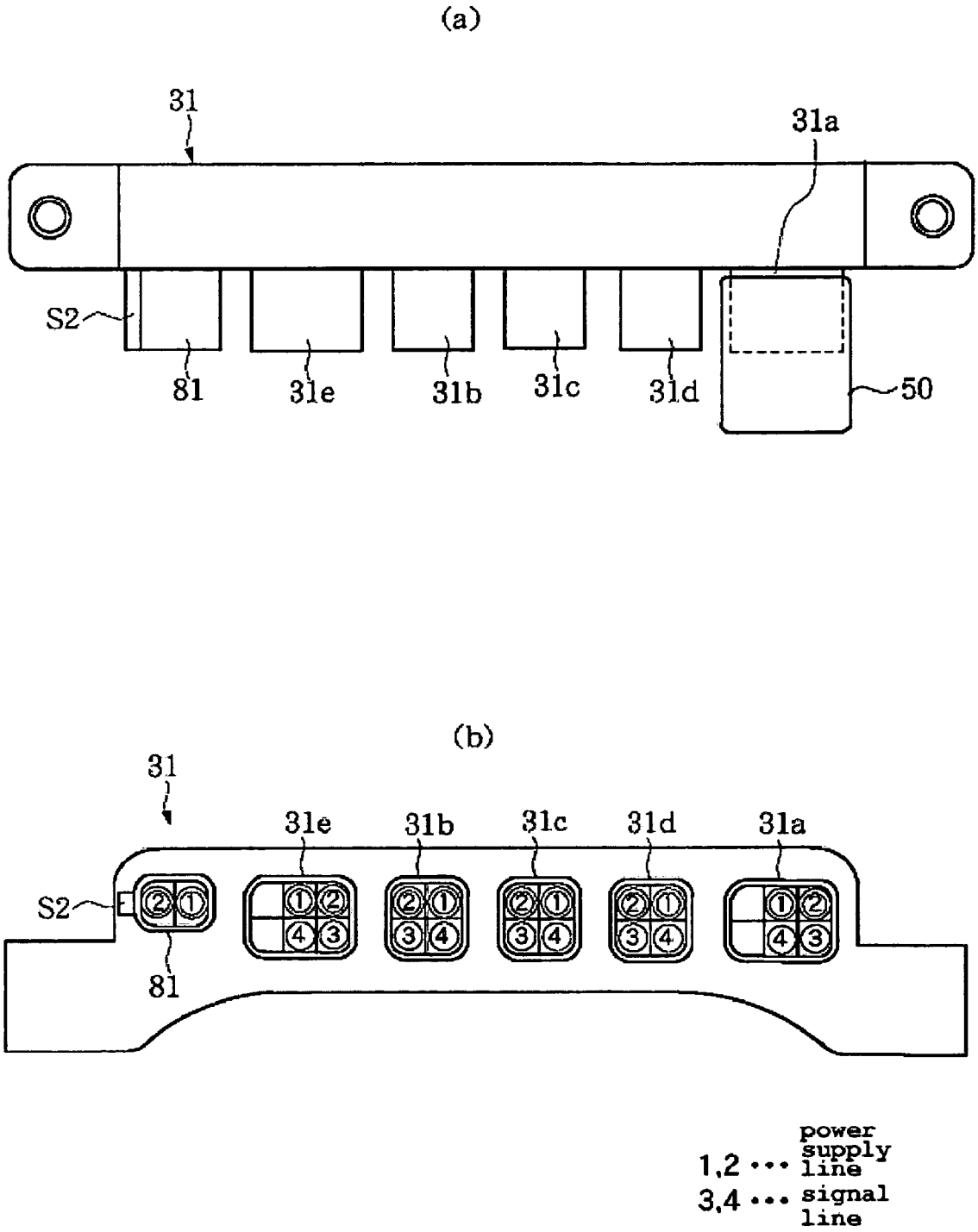
FIG. 4(*a*) is a top plan view of an exemplary stern-side hub.

The stern-side hub 31 can be provided with, as shown in FIG. 1 and FIG. 4, a terminating resistance connecting terminal BUS31*a*, engine connecting terminals DEV31*b*–31*d*, a HUB connecting terminal BUS31*e* and a system power supply terminal P81. The terminating resistance connecting terminal BUS31*a* can be connected with a terminating resistance device RES50.

Figure 5:
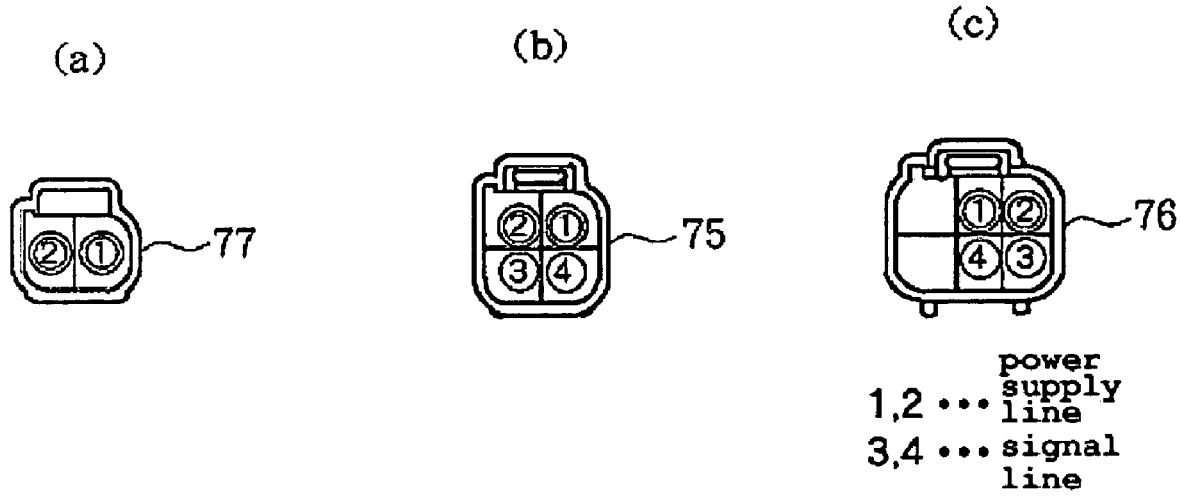
FIGS. 5(*a*), (*b*), and (*c*) are elevation view of a fitting connector of the stern-side hub.

The engine connecting terminals DEV31*b*–31*d* can be connected with the engine controllers 21*a*, 21*b*, 21*c* with the LAN cables 60*d*, 60*e*, 60*f*. These LAN cables 60*d*, 60*e*, 60*f* are connected through fitting connectors 75 shown in FIG. 5(*b*). The LAN cables 60*d*, 60*e*, 60*f* can each have signal lines and power supply lines. Exemplary but non-limiting layouts for the power supply connectors and signal line connectors in the connector devices 75, 76 are shown in FIGS. 5(*b*), 5(*c*). The engine controllers 21*a*, 21*b*, 21*c* can be connected through the signal lines of the LAN cables 60*d*, 60*e*, 60*f*.

That is, although the power supply lines are included in the LAN cables 60*d*, 60*e*, 60*f* connecting the stern-side hub 31 to the engine controllers 21*a*, 21*b*, 21*c*, no electric power is transmitted between the stern side hub 31 and the engine controllers through these lines. Rather, as indicated by the "x" marks, no electric power is transmitted through the LAN cables 60*d*, 60*e*, 60*f*. Therefore, the boat LAN system is configured such that no power is supplied through the controllers of the engines 21*a*, 21*b*, 21*c* to the LAN.

Figure 3:
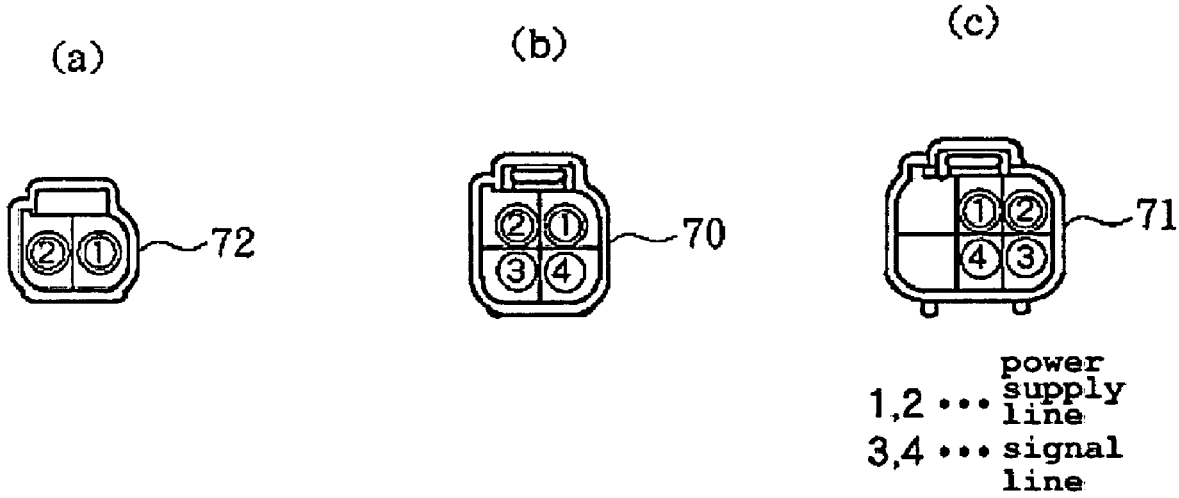
FIGS. 3(*a*), (*b*), and (*c*) are elevational views of three exemplary fitting connectors of the pilot seat-side front hub shown in FIG. 2.

A bus cable 60*g* can be connected to the HUB connecting terminal BUS30*e* of the pilot seat-side front hub 30 and the HUB connecting terminal BUS31*e* of the stern-side hub 31 with fitting connectors 71, 76, respectively. An exemplary fitting connector 71 is shown in FIG. 3(*c*) and an exemplary fitting connector 76 in FIG. 5(*c*). The bus cable 60*g* has signal lines and power supply lines. In this embodiment, there is provided a boat LAN system B forming a communication network between the devices A and the engine controllers 21*a*, 21*b*, 21*c*.

In the illustrated embodiment, there are provided engine batteries 17*a*, 17*b*, 17*c*, connected by power switches SW1, SW2, SW3, corresponding to the engines 20*a*, 21*b*, 20*c* of the three outboard motors 12*a*, 12*b*, 12*c*.

At least one of the system power supply terminal P80 of the pilot seat-side front hub 30 and the system power supply terminal P81 of the stern-side hub 31 can be selected for the connection to a system power supply. An exemplary fitting connector 72 that can be connected to the system power supply terminal P80 is shown in FIG. 3(*a*), and an exemplary fitting connector 77 that can be connected to the system power supply terminal P81 is shown in FIG. 5(*a*).

For example, a power supply line 90, having an in-line switch SW1 connected to the engine battery 17*a*, can be connected to the system power supply terminal P80 of the pilot seat-side front hub 30. In this case, the system power supply is the engine battery 17*a*. In some embodiments, the power supply line 90 from the power switch SW1 (illustrated in dash-dot-dot line) can be connected to the system power supply terminal P81 of the stern-side hub 31.

In some embodiments, when an accessory power supply battery 85 is disposed for example, at the front of the hull 11 or at another location, a power supply line 91 connected to the accessory power supply battery 85 through a power switch SW4 can be connected to the system power supply terminal P80 of the pilot seat-side front hub 30. In this case, the system power supply is the accessory power supply battery 85.

In some embodiments where an accessory power supply battery 86 is disposed at the rear of the hull 11, a power supply line 92 from a power switch SW5 connected to the accessory power supply battery 86 can be connected to the system power supply terminal P81 of the stern-side hub 31. In this case, the system power supply is the accessory power supply battery 86.

Further, the system power supply terminal P80 can be provided with a fitting detection sensor S1 for detecting the fitting of the fitting connector 72. Optionally, the system power supply terminal P81 can be provided with a fitting detection sensor S2 for detecting the fitting of the fitting connector 77. Detection information of the fitting detection sensors S1, S2 can be sent to a control section 100.

In some embodiments, alarm means 101 can also be connected to the control section 100. In the control section 100, an alarm can be sounded by the alarm means 101 if a system power supply is connected to both the system power supply terminal P80 of the pilot seat-side front hub 30 and the system power supply terminal P81 of the stern-side hub 31. The alarm means 101 can be, for example but without limitation, made up of alarm lamps or alarm buzzers and the like. Thus, an alarm can be sounded if a system power supply is connected to both the system power supply terminals P80 and P81 of the pilot seat-side front hub 30 and the stern-side hub 31, and system power is supplied from a single power supply, so that the quality of communication can be secured.

In some embodiments, although system power supply terminals P80, P81 can be provided on both the pilot seat-side front hub 30 and the stern-side hub 31, respectively, and either one of the terminals can be selected for the connection of a system power supply, at least one of the hubs is provided with a system power supply terminal, and thus electric power can be supplied to the LAN system B for a boat, not through a power supply circuit of the boat engine, thereby providing stable operation of the LAN system of a boat.

Further, since both of the pilot seat-side front hub 30 and the stern-side hub 31 are provided with system power supply terminals P80, P81, respectively, the degree of freedom of power supply is enhanced. Further, since a power supply is connected to only one of the system power supply terminals P80 and P81, no difference in power supply voltage is produced within the boat LAN system B, providing stable operation of the boat LAN system B. Further, the system power supply is an accessory power supply battery or an engine battery, which extends the freedom of power supplies in the boat LAN system B.

In some embodiments, since at least one of the pilot seat-side front hub and the stern-side hub is provided with a system power supply terminal, electric power can be supplied to a boat LAN system, not through an power supply circuit of the boat engine, so that the boat LAN system can be operated stably.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A network system for a boat having operator's devices disposed in a hull, a propulsion unit mounted on the hull, and an engine for driving the propulsion unit, the network system comprising a pilot seat-side front hub connected with the operator's devices, a stern-side hub connected with a controller for the engine, a bus cable having a power supply line connecting the pilot seat-side front hub with the stern-side hub, and at least a first system power supply terminal provided on at least one of the pilot seat-side front hub and the stern-side hub, wherein the network system is configured such that both of the pilot seat-side front hub and the stern-side hub can be powered by a single power supply being connected to the first power supply terminal.

2. The network system as set forth in claim 1, wherein the first system power supply terminal is provided on the pilot seat-side front hub and the stern-side hub includes a second system power supply terminal, and wherein a power supply is connected to only one of the first and second system power supply terminals.

3. The network system as set forth in claim 2, additionally comprising alarm means for sounding an alarm if a system power supply is connected to both the first and second system power supply terminals.

4. The network system as set forth in claim 1, wherein the stern-side hub is configured to be connected to a plurality of propulsion units.

5. The network system as set forth in claim 2, additionally comprising an alarm device configured to sound an alarm if a system power supply is connected to both the first and second system power supply terminals.

6. A network system for a boat having operator's devices disposed in a hull, a propulsion unit mounted on the hull, and an engine for driving the propulsion unit, the network system comprising a pilot seat-side front hub connected with the operator's devices, a stern-side hub connected with a controller for the engine, at least a first system power supply terminal provided on at least one of the pilot seat-side front hub and the stern-side hub, and means for powering both of the pilot seat-side front hub and the stern-side hub can with a single power supply being connected to the first power supply terminal.

7. The network system as set forth in claim 6, wherein the first system power supply terminal is provided on the pilot seat-side front hub and the stern-side hub includes a second system power supply terminal, the network system additionally comprising alarm means for sounding an alarm if a system power supply is connected to both the first and second system power supply terminals.

8. The network system as set forth in claim 6, wherein the stern-side hub is configured to be connected to a plurality of propulsion units.

9. A boat having operator's devices disposed in a hull, a propulsion unit mounted on the hull, and an engine for driving the propulsion unit, a network system comprising a pilot seat-side front hub connected with the operator's devices, a stern-side hub connected with a controller for the engine, a bus cable having a power supply line connecting the pilot seat-side front hub with the stern-side hub, and at least a first system power supply terminal provided on at least one of the pilot seat-side front hub and the stern-side hub, wherein the network system is configured such that both of the pilot seat-side front hub and the stern-side hub can be powered by a single power supply being connected to the first power supply terminal.

10. The boat as set forth in claim 9, wherein the first system power supply terminal is provided on the pilot seat-side front hub and the stern-side hub includes a second system power supply terminal, and wherein a power supply is connected to only one of the first and second system power supply terminals.

11. The network system as set forth in claim 10, additionally comprising alarm means for sounding an alarm if a system power supply is connected to both the first and second system power supply terminals.

12. The network system as set forth in claim 9, wherein the stern-side hub is configured to be connected to a plurality of propulsion units.

13. The network system as set forth in claim 10, additionally comprising an alarm device configured to sound an alarm if a system power supply is connected to both the first and second system power supply terminals.

* * * * *

UNITED STATES PATENT AND TRADEMARK OFFICE

CERTIFICATE OF CORRECTION

PATENT NO. : 7,144,283 B2
APPLICATION NO. : 11/257213
DATED : December 5, 2006
INVENTOR(S) : K. Kawase It is certified that error appears in the above-identified patent and that said Letters Patent is hereby corrected as shown below:

At column 2, line 50, please delete “elevation” and insert therefore, --elevational--.

At column 2, line 52, please delete “elevation” and insert therefore, --elevational--.

Signed and Sealed this

Twenty-seventh Day of November, 2007

JON W. DUDAS
*Director of the United States Patent and Trademark Office*